United States Patent [19]

Pardes

[11] 4,170,077

[45] Oct. 9, 1979

[54] MOVING TARGET SCREEN WITH MODULATING GRID

[76] Inventor: Herman I. Pardes, 45 Wickapecko Dr., Wanamassa, N.J. 07712

[21] Appl. No.: 923,875

[22] Filed: Jul. 12, 1978

[51] Int. Cl.[2] ..... F41G 3/26

[52] U.S. Cl. ..... 35/25

[58] Field of Search ..... 35/25; 273/101.1

[56] References Cited

U.S. PATENT DOCUMENTS

| | | | |
|---|---|---|---|
| 3,888,022 | 6/1975 | Pardes et al. | 35/25 |
| 3,958,871 | 5/1976 | Rosendahl et al. | 35/25 X |
| 3,964,178 | 6/1976 | Marshall et al. | 35/25 |
| 3,996,674 | 12/1976 | Pardes et al. | 35/25 |

*Primary Examiner*—William H. Grieb

*Attorney, Agent, or Firm*—Nathan Edelberg; Sheldon Kanars; Edward Goldberg

[57] ABSTRACT

A moving target simulating system for marksmanship practice including a film projector having a modulating grid thereon for transmitting a modulated infrared light through a film aperture onto a viewing screen is disclosed. The aperture is optically superimposed on the target, and the modulated infrared light reflected from the screen is detected by detectors on the weapons when the weapons are accurately aimed and fired at the target.

10 Claims, 6 Drawing Figures

MOVING TARGET SCREEN WITH MODULATING GRID

STATEMENT OF PRIOR ART AND BACKGROUND OF INVENTION

A system is disclosed in U.S. Pat. No. 3,888,022 entitled Moving Target Screen issued to H. I. PARDES, J. R. SCHWARTZ and F. B. SHERBURNE and assigned to the same assignee as the present invention wherein motion picture scenes are projected on a viewing screen to provide trainees with simulated realistic scenes for tactical and marksmanship training.

The system disclosed in U.S. Pat. No. 3,888,022 is particularly directed such as to military applications wherein there is a requirement to keep each weapon unencumbered such as by wire connections and accessories. The environment wherein the system of Patent No. 3,888,022 is utilized permits each of the weapons utilized to generate a low power laser beam which is aimed onto the target.

Another system is disclosed in U.S. Pat. No. 3,964,178 issued to Marshall et al. directed to a weapon fire simulator system utilizing film projectors. The system of U.S. Pat. No. 3,964,178 utilizes relatively complicated electronic circuits, as well as a sophisticated optic and lens assembly.

In the systems of U.S. Pat. Nos. 3,888,022 and 3,964,178 cost constraints and possible safety complications of using lasers in public facilities are not overriding considerations. Thus because of public safety requirements and legal technicalities it is often not feasible to utilize the systems disclosed in U.S. Pat. Nos. 3,888,022 and 3,964,178.

The present invention describes a system particularly useful in permanent type of simplified installations such as in fixed target ranges or in amusement park games, where it is possible to hard wire, that is electrically connect the weapon to a scoring display. The electronics of the present invention, as well as the lens assembly are simplified relative to the cited patents thereby reducing the expense of the overall system.

SUMMARY OF THE INVENTION

The present invention discloses a system for providing a simulated target scene on a projector screen enabling the operator to practice marksmanship. A film projector projects a target scene on the screen, with one or more targets located in each scene. When the weapon operator accurately fires his weapon at the target, the electronic circuitry indicates that the target has been hit. The invention provides a structure and technique for transmitting a modulated infrared light through an aperture in the film onto a viewing screen. The aperture is optically superimposed on a target on the screen and the modulated infrared light reflected from the screen is detected by detectors mounted on a weapon when that weapon is accurately aimed at the target.

Further objects of the invention will be readily apparent from the following detailed description of preferred embodiments, when considered in conjunction with the drawings, wherein:

DESCRIPTION OF THE PREFERRED EMBODIMENT OF THE INVENTION

Figure 2:
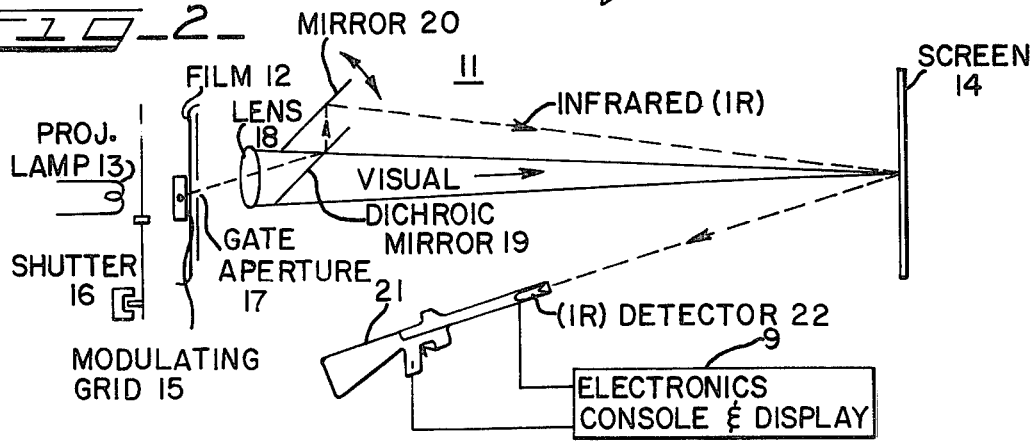
FIG. 2 depicts the optics or lens assembly utilized in the projection system of the invention.

Refer first to FIG. 2 which depicts the optics or lens assembly 11 of the invention. Reference is also made to U.S. Pat. No. 3,888,022 cited hereinabove which describes the basic details of the optics assembly such as shown in FIG. 2. In FIG. 2, the pictorial scene or image on a film 12 frame is projected onto the viewing screen 14 by a projection lamp 13, shutter 16, modulating grid 15, gate aperture 17, condensing lens 18, and a stereo reflector consisting of a dichroic mirror 19 and a first surface mirror 20.

Figure 5:
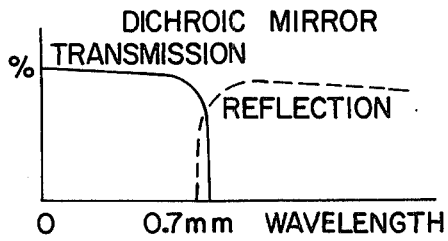
FIG. 5 is a graph useful in explaining the operation of the invention.

As is known, dichroic mirror 19 is designed to pass light having wavelengths within a certain range and to reflect light having wavelengths outside the selected range. For example, as indicated in FIG. 5, the dichroic mirror 19 is designed to pass light of a wavelength below approximately 0.75 micrometers and to reflect light above that wavelength. Accordingly with dichroic mirror 19 positioned at approximately a 45° angle with the plane of the lens 18, as shown in FIG. 2, the visible light from the projection lamp 13 passes through the lens 18 and the dichroic mirror 19 to illuminate the screen 14. The infrared light, from projection lamp 13, which is above 0.7 mm in wavelength, will be reflected upwardly by the mirror 19 toward mirror 20. Mirror 20 is tiltable, and adjustable relative to the stationary dichroic mirror 19, and is adjusted to reflect the infrared light beam toward the screen 14, as shown in FIG. 2.

Mirror 20 may also be a dichroic mirror so that any residual visible light, which may be undesirable, is virtually eliminated. Most of such residual visible light would pass through mirror 20 and hence would not be reflected toward the screen; a 90% to 100% transmission ratio is standard.

The film 12 projection provides a pictorial scene on screen 14, and each scene has one or more targets located thereon. In operation, the marksman aims his weapon (rifle) 21 at the target. Weapon 21 has infrared (IR) detector 22 mounted thereon. When weapon 21 is properly aimed at the target 24, and its trigger is actuated to enable the associated electronic circuit, infrared (IR) light reflected from the screen 14 actuates the IR detector 22, to provide an indication that the weapon has effectively hit the target, all of which will be explained hereinafter.

Figure 3:
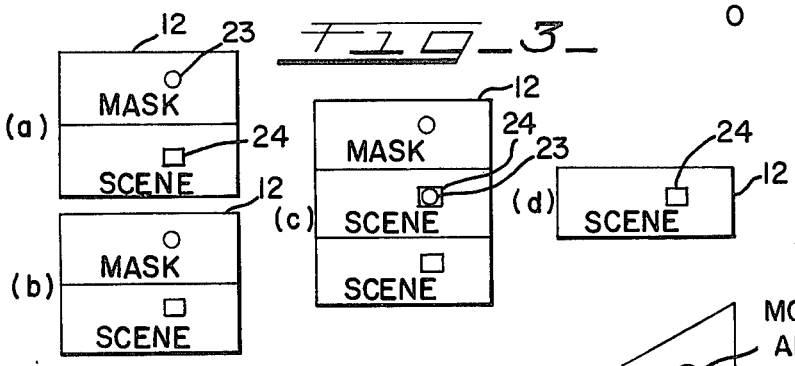
FIG. 3 shows a film superpositioning arrangement utilized on the invention.

Refer now also to FIG. 3, which illustrates the superpositioning of film frames as discussed in detail in U.S. Pat. No. 3,888,022, cited above. In FIG. 3, one half of each film frame 12, contains an inverted normal positive scene, while the other half of each film frame contains a mask consisting of an opaque background in which there are formed one or more transparent apertures 23. The aperture or apertures 23 are located at the same relative position on the mask portion of each film frame 12, as the corresponding target or targets 24 on the scene portion of each frame. Thus, as labeled in FIG. 3, each projected film frame 12 includes a scene portion, and a mask portion within which respective bright spots corresponding to the apertures 23 appear. Apertures 23 are approximately 0.5 mm across.

Figure 4:
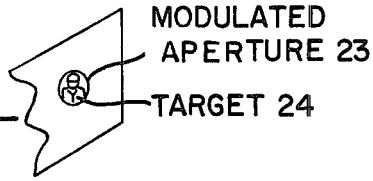
FIG. 4 shows modulated aperture superpositioned on a target.

Refer now also to FIG. 2. In operation, a film frame 12 with a scene and a mask image (see FIG. 3*a*) is projected through the dichroic mirror 19 onto the screen 14. A second and identical scene and mask image, (see FIG. 3*b*) is reflected from dichroic mirror 19 to mirror 20 and thence projected onto the screen 14. The movable mirror 20 is next adjusted until the apertures 23 or bright spots in the mask portion are superimposed on the targets 24 in the scene portion of the projected image as indicated in FIG. 3*c*, and in FIG. 4. After the proper initial adjustment of the mirror 19 has been made, the film gate aperture 17 is arranged to block out the lower scene portion view of FIG. 3*c* to provide a view as shown in FIG. 3*d*. Accordingly, only the scene portion of the projected image will be visible to the marksman, but the scoring aperture 23 will effectively be positioned on the target 24, as indicated in FIG. 4.

The operator or trainee thus, sees the actual target scene on the screen and aims the weapon 21 at the target 24. When the weapon 21 is accurately aimed at the target, the infrared light reflected from the screen 14, impinges on detector 22 in the weapon 21, as indicated by the dotted lines in FIG. 2. The inventive system thus simulates actual firing conditions by means of film.

Figure 1:
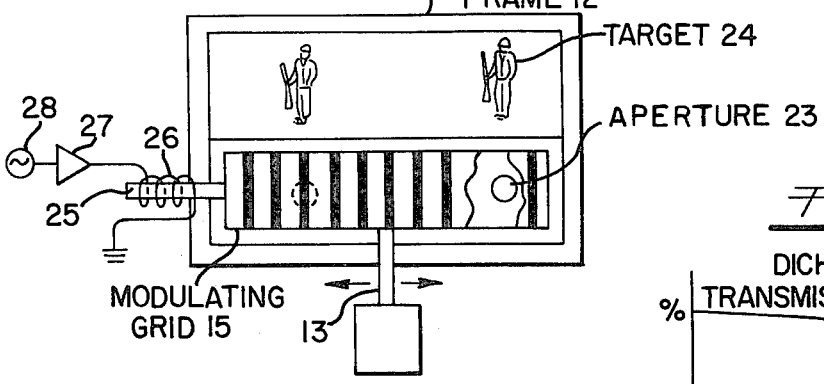
FIG. 1 is a plan view of a vibrating grid and film assembly in accordance with the invention.

FIG. 1, shows a film frame 12 of the type utilized in the inventive system. An etched modulating grid 15 having a dimension which is one half the size of a film frame; and, with bars and clear spaces each of 0.5 mm width, is positioned adjacent film 12, see also, FIG. 2. In one embodiment, the grid is approximately 10 mm in width and 4 mm in length. Each bar grid is mounted on a vibration post 13 located underneath the film frame. The modulating grid 15 may be positioned in place of the detector shown in the drawings of Patent No. 3,888,022. Grid 15 includes a laterally extending metallic rod 25, which is arranged to be vibrated by an electrical coil winding 26, connected through an amplifier 27, to an AC source 28, operating at about 1 kHz. The vibrating means for grid 18, may also be of any other suitable known type.

In operation, the grid 15 is caused to vibrate as indicated by the arrows in FIG. 1. The vibration of grid 15 causes the infrared light from the projector lamp 13 to be modulated at a stable frequency. Accordingly, the light emanating from the target aperture 23 is modulated such that when the projector is properly set up for operation, as shown in FIG. 3, each target 24 has in effect a pulsing light emanating therefrom which contains infrared wavelengths.

The vibrating grid 15, is preferably made of the same material as the film 12. The reason for this is that the film transmits light quite well above 0.9 mm. If the bars in the grid were totally opaque, all the light coming through the grid would be modulated, but the longer wavelengths would also pass through the film, and the target apertures would be lost in the noise. The grid, having the same characteristics as the film, will therefore not modulate the longer wavelengths, but will modulate the infrared light. A narrow band spectral filter on each weapon 21 receiver is required. The modulated infrared light is reflected upwardly toward mirror 20 by the dichroic mirror 19 and again reflected from mirror 20 toward the screen 14 and hence the IR beam hits the target 24, and is further reflected from the screen 14, as indicated in FIG. 2.

Figure 6:
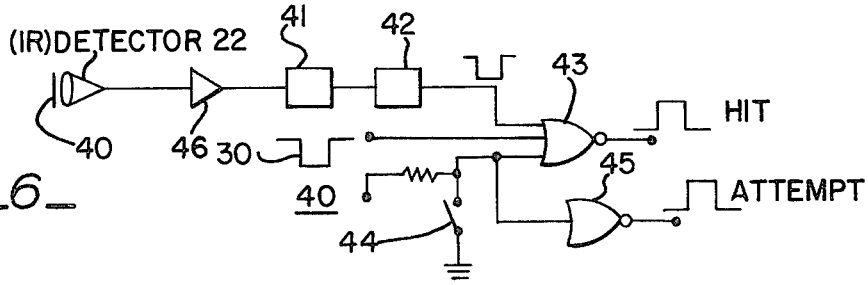
FIG. 6 shows a logic diagram of a portion of the electronic circuit of the inventive system.

As indicated, in FIG. 6, a narrow band filter 40, is provided for each weapon 21 receiver to assure only the IR light is effective on detector 22. In the case of large targets, the annotated film scoring apertures will contain a cluster of smaller apertures or bars of 0.5 mm dimension to insure modulation by the grid 15. A single large aperture would cover several grid lines thereby cancelling the modulation.

A logic diagram of the weapon activation and hit indication portion 40 of the electronics control and display circuit is shown in FIG. 6. When the weapon is properly aimed and fired at the target 24, the infrared light modulated at 1 kHz is filtered through a narrow band filter 40, of any suitable known type, and impinges on the infrared detector 22. The detector 22 provides a signal through an amplifier 46 and phase locked loop 41 to trigger a one-shot multivibrator 42 to provide a negative pulse to a three input NOR gate 43.

When the weapon is actuated to simulate firing, trigger switch 44 is momentarily ($\approx$42 m sec.) closed to effectively enable NOR gates 43 and 45. A third input pulse labeled 30, to NOR gate 43 is received from, for example, a 1 of 10 decoder in the electronics console, and display 9 to individually monitor each one of up to ten weapons in use. As is known, NOR gate 43, will be enabled when its three inputs occur concurrently to provide a hit indication on the display. An indication on the weapon gun sight such as an LED display may also be activated by NOR gate 43.

As can be readily appreciated, each time the trigger is activated, switch 44, closes to activate NOR gate 45, to provide an output pulse indicating an attempt.

Multi-station operation may be implemented as disclosed in U.S. Pat. No. 3,888,022, that is by electronically dividing each motion picture time frame by the number of stations desired. In such system, the synchronizing pulses are generated only during the film "on-time" so that the projector light will pass through the vibrating grid as it does through the film scene. In a typical commercial projector this on-time is approximately 30 milliseconds out of 42 milliseconds at a 24 frame per second rate. It has been found that a vibration rate of 2 kHz provides a sufficient number of pulses for reliable capture with a standard phase-lock loop circuit.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A system for enabling marksmanship practice comprising, in combination, a film frame projector and viewing screen, at least one apparatus simulating a weapon such as a rifle, an infrared detector mounted on said weapon, said projector having a projection lamp for providing energy including visible light and infrared light, said projector including optical means for directing the images of said film to provide a target scene on said screen at which said weapon may be aimed, each film frame including a target scene portion and a mask portion, a light aperture formed in said mask portion corresponding in position to a target on said scene portion, a light grid positioned adjacent the mask portion of said film to affect light passing through said mask portion, said grid having spaced substantially opaque sections, means for vibrating said grid to modulate light passing therethrough and through the apertures in said mask portion, said optical means including lens, a first mirror and a dichroic mirror, said dichroic mirror positioned in the path of the projected images and of the infrared light and positioned at an angle with respect to the plane of said lens for allowing visible light to pass therethrough onto said screen while reflecting the modulated infrared light, said first mirror positioned to receive infrared light reflected by said dichroic mirror and arranged to reflect said modulated infrared light to said screen to optically superimpose the aperture on said target and cause the infrared light to impinge on the target, and said screen reflecting said infrared light whereby the infrared detector on said weapon may respond to said modulated infrared light when said weapon is accurately aimed and simulates firing at said target.

2. An apparatus as in claim 1 wherein said grid includes mounting means including a metallic rod, coil winding means adjacent said rod, alternating current (A.C.) means for energizing said winding whereby said rod is caused to reciprocate at the A.C. rate to thereby modulate said infrared light.

3. An apparatus as in claim 1 wherein said grid compares alternative opaque bars and clear spaces each approximately 0.5 mm in width and said apertures are 0.5 mm in diameter.

4. An apparatus as in claim 3 wherein multiple apertures are provided in said mask portion to correspond to respective targets on said scene portion.

5. An apparatus as in claim 1 wherein said first mirror is a dichroic mirror whereby substantially all visible light passing through said aperture is eliminated.

6. An apparatus as in claim 1 further including electronic means for selectively responding to one of a plurality of weapons concurrently simulating firing at said targets.

7. An apparatus as in claim 6 further including a narrow band filter for filtering the light directed to said detector.

8. An apparatus as in claim 6 further including means for providing a first electrical signal indicating the simulated firing of a weapon, said detector providing a second electrical signal indicating the target has been hit, a third electrical signal indicating firing of a designated weapon, a first electronic gating means receiving said three signals, and display means activatable by said gating means when said three signals occur concurrently to thereby display a target hit.

9. An apparatus as in claim 8 further including a second electronic gating means responsive to said first and third signals occurring concurrently to activate the display means to indicate that a selected weapon has been fired.

10. An apparatus as in claim 8 further including a display means on said weapon to indicate a target hit.

* * * * *